United States Patent [19]

Jessel

[11] 4,450,798

[45] May 29, 1984

[54] ENGINE INTAKE VALVE WITH HEAT PIPE

[75] Inventor: Alfred J. Jessel, San Rafael, Calif.

[73] Assignee: Chevron Research Company, San Francisco, Calif.

[21] Appl. No.: 432,193

[22] Filed: Oct. 1, 1982

Related U.S. Application Data

[63] Continuation of Ser. No. 221,488, Dec. 30, 1980, abandoned.

[51] Int. Cl.[3] ..... F01P 3/14

[52] U.S. Cl. ..... 123/41.41; 123/188 A

[58] Field of Search ..... 123/188 A

[56] References Cited

U.S. PATENT DOCUMENTS

| | | | |
|---|---|---|---|
| 1,442,698 | 1/1923 | Page | 123/41.41 X |
| 1,655,149 | 1/1928 | Lee | 123/41.41 |
| 2,416,866 | 3/1947 | Bronander | 123/41.41 |
| 3,701,342 | 10/1972 | Owsley et al. | 123/188 A |
| 3,728,994 | 4/1973 | Bachle | 123/41.41 X |

FOREIGN PATENT DOCUMENTS

| | | | |
|---|---|---|---|
| 122186 | 2/1920 | United Kingdom . | |
| 122171 | 5/1920 | United Kingdom . | |
| 1438740 | 6/1976 | United Kingdom | 123/41.41 |

*Primary Examiner*—William A. Cuchlinski, Jr.
*Attorney, Agent, or Firm*—G. W. Wasson; L. S. Gruber; Edward J. Keeling

[57] ABSTRACT

An internal combustion engine intake valve with an internal heat pipe. The valve stem and valve head are hollow and have a wicking material fixed to the internal hollow surface. A coolant material is contained within the hollow valve. A heat exchanger is provided on the outer surface of the stem at the valve operator end. The portion of the valve in the fuel intake system is maintained at a temperature that will prevent the addition of heat to the fuel charge from the valve thus reducing the possibility of autoignition due to heating of the fuel charge.

3 Claims, 3 Drawing Figures

FIG. 2
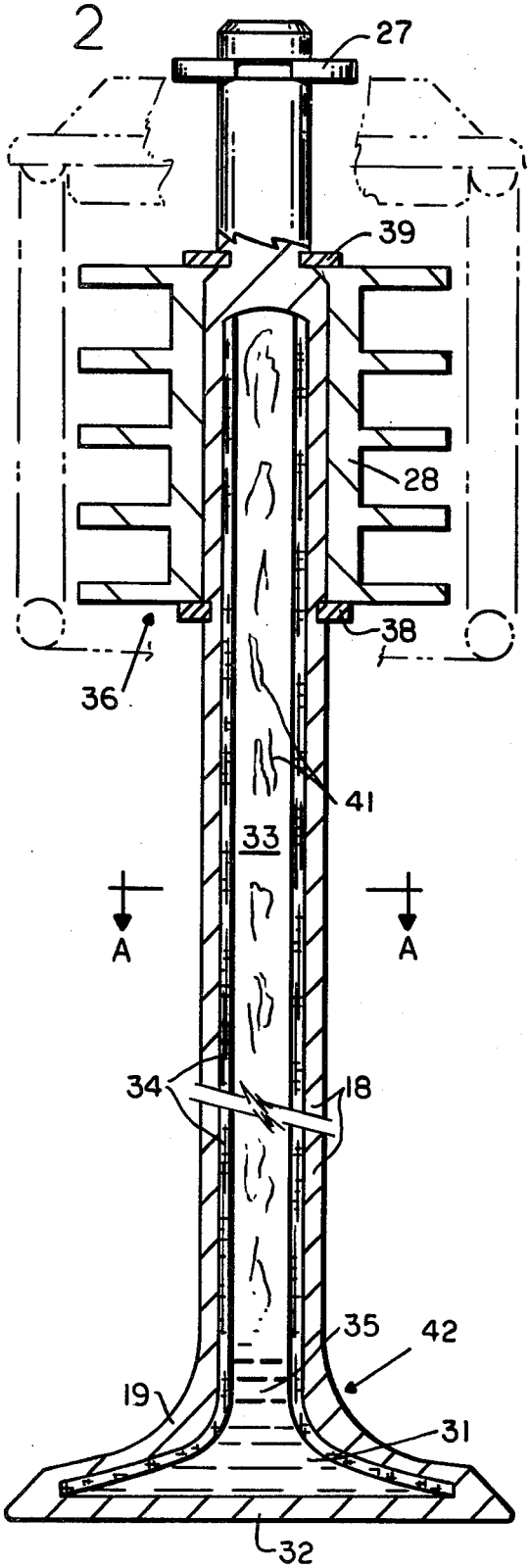
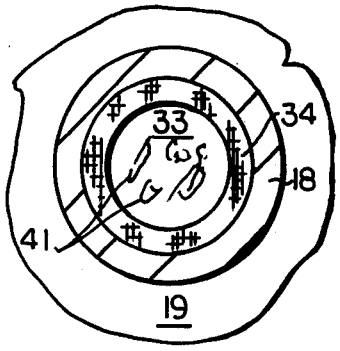
FIG. 3
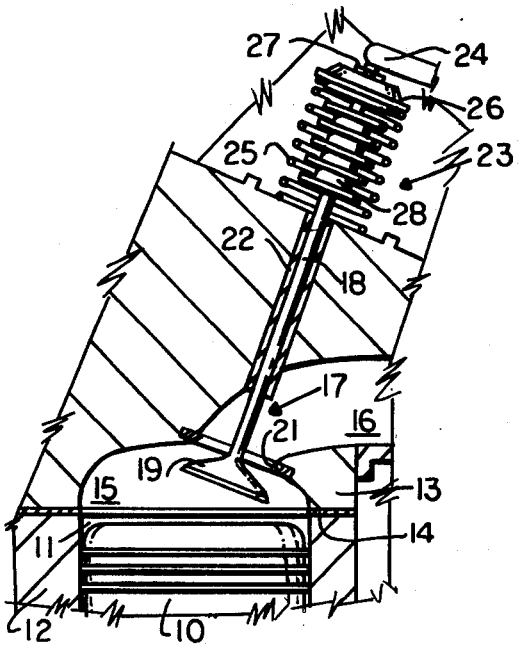
FIG. 1

ENGINE INTAKE VALVE WITH HEAT PIPE

This is a continuation of application Ser. No. 221,448, filed Dec. 30, 1980 now abandoned.

FIELD OF THE INVENTION

This invention relates to an intake valve and particulary a fuel intake valve for an internal combustion engine.

BACKGROUND OF THE INVENTION

The internal combustion engine and the fuels consumed in such engines have both undergong recent significant changes. The internal combustion engine as presently used in motor vehicles has been reduced substantially in size, to reduce engine weight, and the engine has been designed to accomplish higher horsepower per weight ratios than engines of previous design. Concurrently, the fuels available for operating such engines have been reformulated to accomplish improved combustion within the engine and to reduce engine emissions which may contribute to undesirable air polution. The combination of the engine and fuel modifications has changed the manner in which engine efficiency is accomplished. For example, whereas in years past it was possible to accomplish increased horsepower from an engine design by increasing the compression ratio and using a fuel of higher octane, it is now economically difficult to produce the required high octane fuels from available crude petroleum stock and the addition of octane-improving additives has been severely restricted. Alternate approaches to accomplishing the engine horsepower maximization with the available fuels are therefore being considered.

It is known that the power available from an internal combustion engine can be increased by reducing the temperature of input fuel charge. See National Advisory Committee for Aeronautics, Technical Note No. 839, Rise in Temperature of the Charge in its Passage Through the Inlet Valve and Port of an Air-Cooled Aircraft Engine Cylinder, by J. E. Forbes and E. S. Taylor, 1942.

The present invention relates to a method and means for treating the input fuel charge to an internal combustion engine prior to entry of the fuel charge into the combustion chamber with a novel intake valve design.

PRIOR ART

Prior art engines have included input fuel charge cooling by design of the fuel input manifold including the seat against which an intake valve operates. The usual objective of such manifold designs is to provide an efficient fuel path from the fuel source to the combustion zone and a valve closure that assures complete sealing of the combustion zone prior to the compression of the fuel charge in the combustion chamber. Intake manifold and valve seat designs have provided for valve seat cooling to avoid warping of the valve seat with the resultant incomplete sealing and therefore loss of compression within the combustion chamber.

Some attention has been directed to the intake valve design to provide for dissipation of heat, but such attention has been directed to removal of heat to avoid damage to the valve and to insure proper valve seating rather than for controlling the temperature of the input fuel charge. In the most part, such valve cooling designs have been directed toward exhaust valves rather than intake valves. See U.S. Pat. Nos. 3,892,210, issued July 1, 1975, 4,000,730, issued Jan. 4, 1977, and 4,182,282, issued Jan. 8, 1980.

Exhaust valves have been designed with hollow stem and head construction to provide an internal chamber for containing a coolant. See U.S. Pat. Nos. 3,871,339, issued Mar. 18, 1975, and 4,164,957, issued Aug. 21, 1979.

In each of these prior art designs, the objective is to cool the valve itself to avoid damage to the valve.

SUMMARY OF THE PRESENT INVENTION

The present invention relates to an intake valve for an internal combustion engine and a method of supplying a lower temperature input fuel charge to an internal combustion engine whereby the power derived from the internal combustion engine may be increased without modification of the design of the combustion chamber or the formulation of the input fuel charge, or the power derived from the engine may be maintained while using a lower octane rated fuel.

Autoignition of the fuel charge in an internal combustion engine is known to result in a reduction of engine efficiency. Autoignition in spark-fired engines is the extremely rapid combustion of the last part of the fuel charge to burn in the combustion chamber. When Autoignition occurs, it results in a rapid rise in combustion chamber pressure above that for normal combustion and causes high frequency pressure fluctuations and an audible sound that is referred to as knock. When knock occurs, large amounts of heat are transferred to engine parts resulting in a loss of power and, if sustained, can result in engine damage.

The foregoing Technical Note No. 839 of J. E. Forbes and E. S. Taylor observes that a decrease in average valve-and-seat temperature of 45° F., which results in a 5° F. reduction in fuel charge temperature in their test engine, permitted an increase in mean effective pressure for the input fuel charge while maintaining the tendency or knock constant. They conclude that, in their engine, a 10° F. reduction in inlet valve-and-seat temperature should permit an increase of approximately 0.7 percent in indicated horsepower without increasing the tendency toward knock.

In accordance with the present invention, the reduction in fuel charge temperature is accomplished by the valve design herein shown. The object of the invention is to accomplish a reduction in heat transferred to the fuel charge by passing the fuel charge through an intake system having a valve with heat dissipating elements.

A further object of the present invention is a method for reducing the tendency toward autoignition in an internal combustion engine by extracting heat from elements within the path of the fuel charge to the combustion zone of the engine.

Other objects and features of the present invention will be readily apparent to those skilled in the art from the appended drawings and specification illustrating a preferred embodiment wherein:

FIG. 1 is a partial sectional view through a cylinder of an internal combustion engine showing the fuel intake path and an intake valve in said path;

FIG. 2 is an enlarged partial sectional view of the valve of the present invention;

FIG. 3 is a sectional view taken along the lines A—A of FIG. 2.

FIG. 1 illustrates a partial sectional view through the cylinder of an internal combustion engine. As illustrated, a piston 10 is operated by conventional means within the cylinder 11 to accomplish compression within a combustion chamber formed by the block 12 and head 13 with the conventional gasket means 14 separating the block and head. The combustion chamber includes the portion 15 within the head wherein combustion actually takes place.

A fuel intake system is provided at 16 which is connected through a conventional intake manifold and carburetor to a supply of fuel, none of the manifold or carburetion system are herein illustrated. An intake valve 17 having a stem portion 18 and a head portion 19 operates with the head portion within the combustion chamber 15 and seats against a valve seat 21 suitably held within the head 13. The stem portion 18 operates through a valve guide 22 passing through the head 13 between the fuel intake system and a valve operating means area 23 conventionally enclosed by a valve cover, not herein shown.

The end of the valve stem 18 in the valve operating means area 23 is in contact with a valve operator 24 which is, in a conventional internal combustion engine, oscillated by operation of a cam mechanism in synchronism with the operation of the piston 10 within the combustion chamber 15. The operator 24 presses against the end of the stem of the valve to oscillate the valve up and down within the combustion chamber and against the valve seat 21.

The valve is biased into a closed position with the valve head 19 in contact with valve seat 21 by the bias of a valve spring 25 pressing at one end against the external surface of the head 13 and at its other end against a spring retainer 26 held in place by a keeper 27 engaging the end of the stem 18 of the valve.

The valve herein illustrated has the addition of a heat exchanger means 28 fixed to the end of the valve stem in the valve operating means area and serving a function to be described hereinafter.

FIG. 2 is an enlarged view, partially in section, of the valve of the present invention removed from the internal combustion engine. In this figure, part of the spring, the retainer, and the keeper are shown in phantom to permit the valve to be more fully illustrated. The valve of the present invention includes an internal chamber 31 between the cap 32 within the head 19. The stem 18 includes a hollow internal channel 33 connected to the internal chamber 31 in the head and extending through the entire length of the stem with the exception of a small portion of the top thereof where engagement of the stem and the valve operator 24 occur. The internal surface of the internal chamber 31 and the internal channel 33 is covered by a wicking material 34 and the chamber and channel are hermetically sealed to provide for containment of a coolant material 35.

The end of the valve at the stem end opposite to the head end is provided with an external heat exchanger 36 which is formed with a plurality of annular fins 37 spaced axially along the heat exchanger. The heat exchanger may be permanently fixed to the stem of the valve as by being pressed fit thereon. Alternatively, the heat exchanger may be fixed to the stem of the valve by clip rings 38 and 39 at the bottom and top thereof with respect to FIG. 2. The clip rings would fit into machine slots along the stem of the valve so as to permit the heat exchanger to be added to the valve when installed in the head of the internal combustion engine.

The valve of the present invention is intended to provide a means for avoiding heat transfer to the fuel charge coming through the intake manifold into the combustion chamber 15 of the engine. The coolant material 35 in the internal chamber 31 and internal channel 33 is normally a liquid and is then in contact with the head of the valve in chamber 31. The coolant is heated by the valve cap 32 which itself is heated by the process of internal combustion within the combustion chamber 15. The coolant material has a low vapor pressure and is primarily liquid at ambient temperature but upon being heated by the heat generated within the combustion chamber the vapor pressure rises and part of the coolant is evaporated to form into a vapor phase 41 shown along the upper ends of the stem 18. The external heat exchanger 36 is cooled by the lubricants within the valve operating means area, particularly by lubricating oils passing within that area. The heat exchanger extracts heat from the valve stem and from the vaporized coolant material to cause the material to condense against the wicking material 34. In the condensed form the coolant material passes down the wicking material from the top of the stem toward the head end of the valve to be reheated again by the cap to vaporize and repeat the cycle. As the coolant material passes along the wicking material, the neck portion 42 of the valve is cooled or maintained at temperature of the condensed coolant material. "Cooled" in the sense used herein is a relative term meaning that the surface of the neck portion is cooler than the surface of the cap portion of the valve due to the evaporation and condensation procedures.

The internal chamber 31, internal channel 33 and wicking material 34 function as a heat pipe within the valve. As long as there is both a liquid and vapor phase of the coolant material they are both at the same temperature whereas the cap 32 of the valve and the neck portion 42 may be at different temperatures because of the operation of the heat pipe.

The intake fuel charge passing through the intake channel 16 to the combustion chamber 15 passes the neck portion 42 of the valve and is cooled or prevented from picking up additional heat before entering the combustion chamber. As previously described in the introductory portion of this specification, a process of reducing the fuel charge temperature permits an increase in mean effective pressure for the input fuel charge while maintaining the tendency for autoignition constant. In that respect, the reduction in input fuel charge temperature permits a reasonable increase in the horsepower generated by the ignition process within the combustion chamber without increasing a tendency toward autoignition. Stated in another way, if it is possible to avoid an increase in the input fuel charge temperature it is possible to obtain the same horsepower from a spark ignited internal combustion engine with a fuel having a lower octane rating while avoiding the expected tendency toward autoignition. Autoignition is known as a process wherein the effective horsepower of the combustion process is reduced and the efficiency of the engine is decreased.

With the valve of the present invention, it is possible to avoid heat transfer to the intake fuel charge to the internal combustion engine at the intake valve thus increasing the effective horsepower while decreasing the tendency toward autoignition. This reduction in the tendency toward autoignition has been accomplished without modifying the fuel and without decreasing the compression ratio of the design of the combustion chamber. Each of the foregoing improvements provides for a potential increase in engine fuel efficiency and therefore a reduction of fuel consumption.

It is contemplated that the valve would be assembled in an internal combustion engine head with the valve being inserted from the combustion chamber side and the external heat exchanger added to the valve stem in the valve operating means area after the stem is passed through the valve stem guide 22. The springs retainer and keeper would be then added to maintain the valve biased against the valve seat.

The valve 11 would preferably be formed in pieces from a hollow stem material and a hollowed head. The wicking material would be added before the pieces were permanently joined. The wicking material may be a wire mesh or other woven material that is compatible with cooling material and can withstand the temperatures encountered in the engine. The pieces of the valve may be joined by any welding process including inertia welding.

While a certain preferred embodiment of the invention has been specifically disclosed, it should be understood that the invention is not limited thereto as many variations will be readily apparent to those skilled in the art and the invention is to be given its broadest possible interpretation within the terms of the following claims.

What is claimed is:

1. A method for reducing the tendency toward autoignition in an internal combustion engine without changing engine design, engine operating conditions or fuel composition comprising the steps of:

(a) passing the input fuel charge to the combustion chamber of said engine over a cooled intake valve;

(b) said intake valve being cooled by evaporating and condensing a coolant material contained within said valve;

(c) said coolant material having a liquid phase at ambient temperatures, said liquid phase being partially evaporated to a vapor at the temperature of the portion of said valve which is heated by said internal combustion process, and said vapor phase is condensed to liquid phase at the temperature of lubricating materials in said internal combustion engine;

whereby the temperature of said input fuel charge is maintained.

2. The method of claim 1 wherein said condensed coolant material passes within said valve to cool a portion thereof which is in contact with said input fuel charge whereby said temperature of said input fuel charge is maintained.

3. A method for reducing the tendency toward autoignition in an internal combustion engine without changing engine design, engine operating conditions, or fuel composition comprising the steps of passing the input fuel charge to the combustion chamber of said engine over an intake valve cooled by evaporating and condensing a coolant material contained within said valve and evaporated by contact with the portion of said valve which is heated by said internal combustion process and condensed by contact with the portion of said valve which is cooled by lubricating materials in said internal combustion engine, wherein said coolant material includes a liquid phase at ambient temperatures, said liquid phase is partially evaporated to a vapor at the temperature of said portion of said valve which is heated by said internal combustion process, and said vapor phase is condensed to a liquid at the temperature of lubricating materials in said internal combustion engine.

* * * * *